US009099037B2

(12) United States Patent
Shin et al.

(10) Patent No.: US 9,099,037 B2
(45) Date of Patent: Aug. 4, 2015

(54) ORGANIC LIGHT EMITTING DIODE DISPLAY AND METHOD OF DRIVING THE SAME

(75) Inventors: Kwang-Suk Shin, Yongin (KR); Won-Jun Choe, Yongin (KR)

(73) Assignee: Samsung Display Co., Ltd., Gyeonggi-Do (KR)

( * ) Notice: Subject to any disclaimer, the term of this patent is extended or adjusted under 35 U.S.C. 154(b) by 978 days.

(21) Appl. No.: 13/250,548

(22) Filed: Sep. 30, 2011

(65) Prior Publication Data

US 2012/0256971 A1 Oct. 11, 2012

(30) Foreign Application Priority Data

Apr. 8, 2011 (KR) ..... 10-2011-0032869

(51) Int. Cl.
*G09G 3/32* (2006.01)

(52) U.S. Cl.
CPC ..... *G09G 3/3233* (2013.01); *G09G 2300/0861* (2013.01); *G09G 2320/048* (2013.01); *G09G 2320/064* (2013.01); *G09G 2360/16* (2013.01)

(58) Field of Classification Search
CPC ..... G09G 3/3208–3/3291; G09G 2300/0861; G09G 2320/043–2320/048; G09G 2320/0276; G09G 2320/0233; G09G 2320/064; G09G 2360/16
USPC ..... 345/76–83, 204–214, 690–699; 315/169.3
See application file for complete search history.

(56) References Cited

U.S. PATENT DOCUMENTS

| | | | | |
|---|---|---|---|---|
| 8,565,556 | B2 * | 10/2013 | Toda | 382/300 |
| 2004/0036704 | A1 * | 2/2004 | Han et al. | 345/690 |
| 2004/0223007 | A1 * | 11/2004 | Mamata | 345/690 |
| 2005/0225518 | A1 * | 10/2005 | Yamada et al. | 345/77 |
| 2006/0033445 | A1 * | 2/2006 | Kim et al. | 315/169.3 |
| 2007/0103601 | A1 * | 5/2007 | Izumi | 348/687 |
| 2007/0139406 | A1 * | 6/2007 | Ozawa et al. | 345/211 |
| 2009/0109208 | A1 * | 4/2009 | Yamashita et al. | 345/214 |
| 2010/0309174 | A1 * | 12/2010 | Tomida et al. | 345/204 |
| 2011/0187754 | A1 * | 8/2011 | Yoo | 345/690 |
| 2011/0205442 | A1 * | 8/2011 | Mori et al. | 348/673 |
| 2011/0221791 | A1 * | 9/2011 | Kajiyama et al. | 345/690 |
| 2011/0285759 | A1 * | 11/2011 | Sakai | 345/690 |

FOREIGN PATENT DOCUMENTS

| | | |
|---|---|---|
| KR | 10-2007-0062836 (A) | 6/2007 |
| KR | 10-0952837 (B1) | 4/2010 |

* cited by examiner

*Primary Examiner* — Dmitriy Bolotin
(74) *Attorney, Agent, or Firm* — Knobbe Martens Olson & Bear LLP

(57) ABSTRACT

An organic light emitting diode display having improved display quality is disclosed. The organic light emitting diode display includes pixels positioned at intersections of scan lines and data lines, an emission control unit for controlling emission times of the pixels according to a second emission width signal indicating emission time information of the pixels, and an emission time controller for dividing the pixels into a plurality of blocks and for generating the second emission width signal according to a brightness history of the blocks.

26 Claims, 9 Drawing Sheets

ORGANIC LIGHT EMITTING DIODE DISPLAY AND METHOD OF DRIVING THE SAME

CROSS-REFERENCE TO RELATED APPLICATION

This application claims priority to and the benefit of Korean Patent Application No. 10-2011-0032869, filed on Apr. 8, 2011, in the Korean Intellectual Property Office, the entire content of which is incorporated herein by reference.

BACKGROUND

1. Field

The disclosed technology relates to an organic light emitting diode display and a method of driving the same, and more particularly, to an organic light emitting diode display having improved display quality and a method of driving the same.

2. Description of the Related Technology

Recently, various flat panel displays having reduced weight and volume as compared to cathode ray tubes (CRT) have been developed. Flat panel technologies include liquid crystal display (LCD), field emission display (FED), plasma display panel (PDP), and an organic light emitting diode (OLED) display. Among the FPDs, the organic light emitting diode display displays an image using organic light emitting diodes (OLEDs) that generate light by re-combination of electrons and holes. The organic light emitting diode display has high response speed and is driven with low power consumption.

An OLED display includes a plurality of pixels arranged at the intersections of a plurality of data lines, scan lines, and power source lines in a matrix. The pixels generally include OLEDs and pixel circuits for controlling the amount of current that flows to them. The pixels generate voltages corresponding to data signals and supply corresponding currents to the OLEDs. Thus, light is produced with brightness corresponding to the data signals.

One significant disadvantage of OLED technology is that the diodes deteriorate over time such that the brightness for a given emission time and amount of current changes. Here, the amount of current is determined by data (that is, gray levels) so that the degree of OLED deterioration varies from pixel to pixel and overall display quality degrades.

SUMMARY OF CERTAIN INVENTIVE ASPECTS

One inventive aspect is an organic light emitting diode display. The display includes pixels positioned at intersections of scan lines and data lines, an emission control unit for controlling emission times of the pixels to correspond to a second emission width signal, and an emission time controller for dividing the pixels into a plurality of blocks and for generating the second emission width signal based on brightness history data of the blocks.

Another inventive aspect is a method of driving an organic light emitting diode display. The method includes accumulating brightness data for a plurality of blocks of pixels, and generating level data indicating brightness levels based on the accumulated brightness data of the blocks. The method also includes accumulating the level data for a plurality of frames to generate accumulated level data, comparing the accumulated level data with a threshold value to generate a first control signal if at least one of the accumulated level data is greater than the threshold value and to otherwise generate a second control signal, and incrementally reducing brightness of the pixels if the first control signal is generated.

BRIEF DESCRIPTION OF THE DRAWINGS

The accompanying drawings, together with the specification, illustrate exemplary embodiments, and, together with the description, serve to explain various principles and aspects.

DETAILED DESCRIPTION OF CERTAIN INVENTIVE EMBODIMENTS

Figure 1:
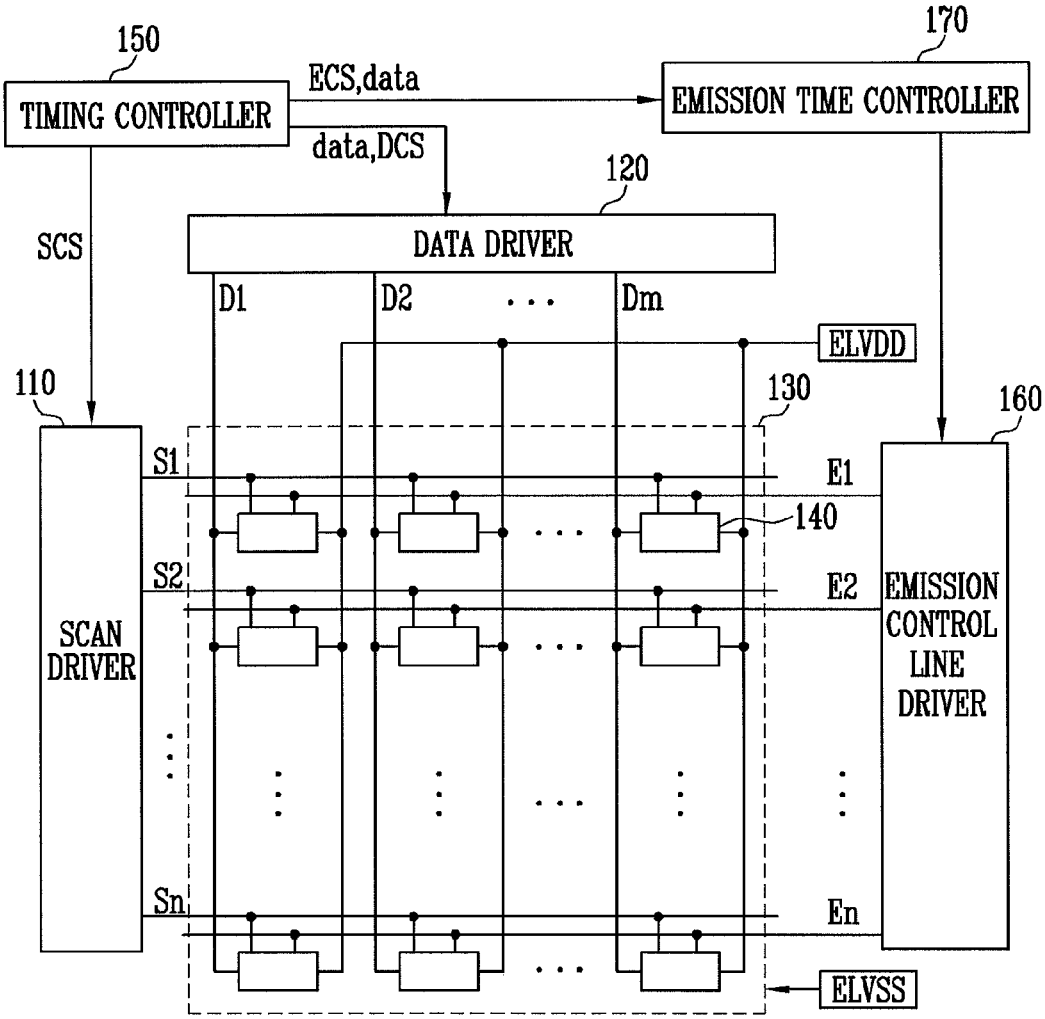
FIG. 1 is a schematic view illustrating an organic light emitting diode display according to an embodiment.

Hereinafter, certain exemplary embodiments are described with reference to the accompanying drawings. Here, when a first element is described as being coupled to a second element, the first element may be not only directly coupled to the second element but may also be indirectly coupled to the second element via a third element. Further, some of the elements that are not essential to the complete understanding of the invention are omitted for clarity. Also, like reference numerals generally refer to like elements throughout.

FIG. 1 is a view illustrating an organic light emitting diode display according to an embodiment. Referring to FIG. 1, the organic light emitting diode display includes a pixel unit 130 including pixels 140 positioned at the intersections of scan lines S1 to Sn, emission control lines E1 to En, and data lines D1 to Dm, a scan driver 110 for driving the scan lines S1 to Sn, an emission control line driver 160 for driving emission control lines E1 to En, a data driver 120 for driving the data lines D1 to Dm, an emission time controller 170 for controlling the emission control line driver 160, and a timing controller 150 for controlling the scan driver 110, the data driver 120, and the emission time controller 170.

The scan driver 110 sequentially supplies scan signals to the scan lines S1 to Sn. When the scan signals are sequentially supplied to the scan lines S1 to Sn, the pixels 140 are selected in units of lines.

The data driver 120 supplies data signals to the data lines D1 to Dm in synchronization with the scan signals. The data signals supplied to the data lines D1 to Dm are supplied to the pixels 140 selected by the scan signals.

The emission control line driver 160 receives a second emission width signal from the emission time controller 170. The emission control line driver 160 that received the second emission width signal generates an emission control signal having a width to correspond to emission time information on the second emission width signal and sequentially supplies the generated emission control signal to the emission control lines E1 to En. Here, the pixels 140 that received the emission control signal are set in a non-emission state and the pixels 140 that did not receive the emission control signal emit light to correspond to the data signals.

The emission time controller 170 divides the pixel unit 130 into a plurality of blocks and accumulates data in each block to determine brightness information. The emission control line driver 160 generates the second emission width signal to correspond to the brightness information and supplies the generated second emission width signal to the emission control line driver 160. Here, the emission time controller 170 generates the second emission width signal so that the deterioration of the OLEDs included in the pixels 140 is minimized.

In detail, the deterioration of the OLEDs is determined by the data (that is, gray levels) and emission time. The emission time controller 170 accumulates data for each block and determines brightness information of each block according to the accumulated data. Then, the emission time controller 170 generates the second emission width signal so that the emission times of the pixels are reduced when emission is performed with brightness of no less than a threshold value in at least one block. That is, when the pixels continuously emit light with high brightness in a frame period, the emission times of the pixels are reduced so that the deterioration of the OLEDs is minimized.

The timing controller 150 supplies a scan control signal SCS to the scan driver 110 and supplies data and a data control signal DCS to the data driver 120. The timing controller 150 supplies a control signal ECS and the data to the emission time controller 170. Here, block control signals, a first emission brightness signal, and a first emission width signal are included in the control signal ECS. The block control signals are for dividing the pixels 140 included in the pixel unit 130 into a plurality of blocks and the first emission brightness signal represents a brightness value that may be displayed by the pixel unit 130. The first emission width signal represents time for which the pixels 140 emit light in one frame period.

In detail, the first emission brightness signal as a signal input from the outside (for example, a user) represents a specific brightness value among the brightness components (that is, 0% to 100%) that may be displayed by the pixel unit 130. For example, the user may supply the first emission brightness signal corresponding to 80% to correspond to an external environment. The first emission width signal input from a controller that is not illustrated to correspond to the external environment includes information on the time for which the pixels 140 may emit light in the one frame period.

The pixel unit 130 includes the pixels 140 positioned at the intersections of the scan lines S1 to Sn and the data lines D1 to Dm. The pixels 140 receive a first power voltage ELVDD and a second power voltage ELVSS. The pixels 140 control the amount of currents supplied from the first power voltage ELVDD to the second power voltage ELVSS through the OLEDs to correspond to the data signals in a period where the emission control signals are not supplied.

Figure 2:
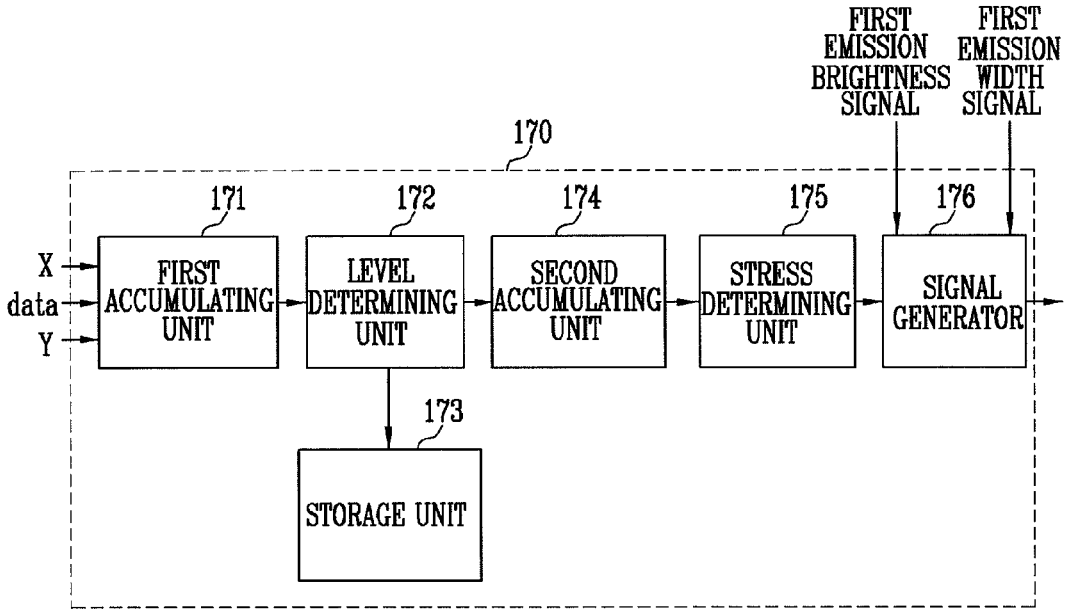
FIG. 2 is a schematic view illustrating an embodiment of the emission time controller of FIG. 1.

FIG. 2 is a block diagram illustrating the emission time controller of FIG. 1. Referring to FIG. 2, the emission time controller 170 according to the embodiment includes a first accumulating unit 171, a level determining unit 172, a storage unit 173, a second accumulating unit 174, a stress determining unit 175, and a signal generator 176.

The first accumulating unit 171 receives the block control signals X and Y and the data from the timing controller 150. The first block control signal X means the number of pixels 140 in a horizontal direction to be included in each block and the second block control signal Y means the number of pixels 140 in a vertical direction to be included in each block.

The first accumulating unit 171 that received the block control signals X and Y divides the pixel unit 130 into a plurality of blocks. Then, the first accumulating unit 171 accumulates the data in each block to generate accumulated data. For example, the first accumulating unit 171 may generate i accumulated data to correspond to i (i is a natural number no less than 2) blocks every frame.

The level determining unit 172 generates level data corresponding to brightness levels of the respective blocks to correspond to the accumulated data supplied from the first accumulating unit 171. Therefore, a plurality of brightness data are stored in the storage unit 173. For example, the plurality of brightness data including first brightness data when all of the pixels included in the blocks emit light with brightness of no less than about 95% on the average and second brightness data when all of the pixels included in the blocks emit light with brightness of no more than about 5% on the average may be stored by the storage unit 173. The level determining unit 172 compares the accumulated data with the brightness data stored by the storage unit 173 and generates the level data to correspond to the comparison result.

The second accumulating unit 174 accumulates level data j (j is a natural number of no less than 2) frame periods to correspond to the respective blocks to generate the accumulated level data. For example, the second accumulating unit 174 accumulates the level data in units of 100 (that is, j=100) frames to generate the accumulated level data.

The stress determining unit 175 receives the accumulated level data of the blocks from the second accumulating unit 174 and compares the received accumulated level data with a threshold value. Here, a first control signal is generated when at least one of the input accumulated level data is larger than the threshold value and a second control signal is generated when at least one of the input accumulated level data is no more than the threshold value.

Here, the threshold value is set as one value among the accumulated level data that may be generated by the stress determining unit 175. When the threshold voltage is set to be large (that is, to correspond to high brightness), the brightness of the pixel unit 130 is maintained to be high and the deterioration speed of the OLEDs increases. When the threshold value is set to be low (that is, to correspond to low brightness), the brightness of the pixel unit 130 becomes low and the deterioration speed of the OLEDs is reduced. The threshold value may be experimentally determined in consideration of the resolution, the size, the brightness characteristic, and the deterioration characteristic of a panel.

The signal generator 176 generates the second emission width signal to correspond to the first control signal or the second control signal supplied by the stress determining unit 175 to supply the second emission width signal to the emission control line driver 160. Here, the signal generator 176 generates the second emission width signal so that the emission times of the pixels are reduced when the first control signal is input and generates the second emission width signal so that emission is performed by a system with predetermined brightness when the second control signal is input.

That is, in some embodiments, the brightness components of the pixels are determined in the blocks in the plurality of frame periods and the emission times of the pixels are reduced when the determined brightness components are greater than the threshold value to prevent the deterioration of the OLEDs.

Figure 3:
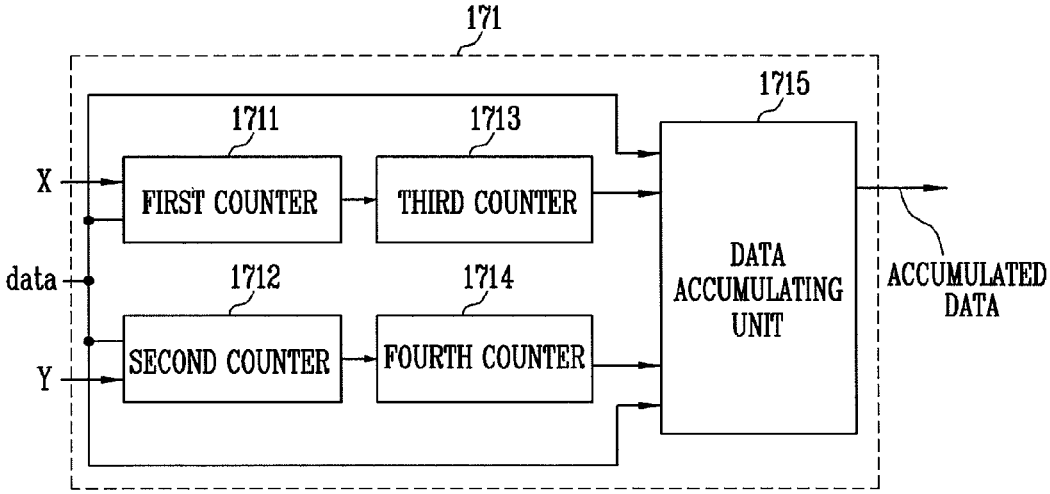
FIG. 3 is a schematic view illustrating an embodiment of the first accumulating unit of FIG. 2.

FIG. 3 is a view illustrating the first accumulating unit illustrated in FIG. 2. Referring to FIG. 3, the first accumulating unit 171 according to the embodiment of FIG. 3 includes a first counter 1711, a second counter 1712, a third counter 1713, a fourth counter 1714, and a data accumulating unit 1715.

Figure 4:
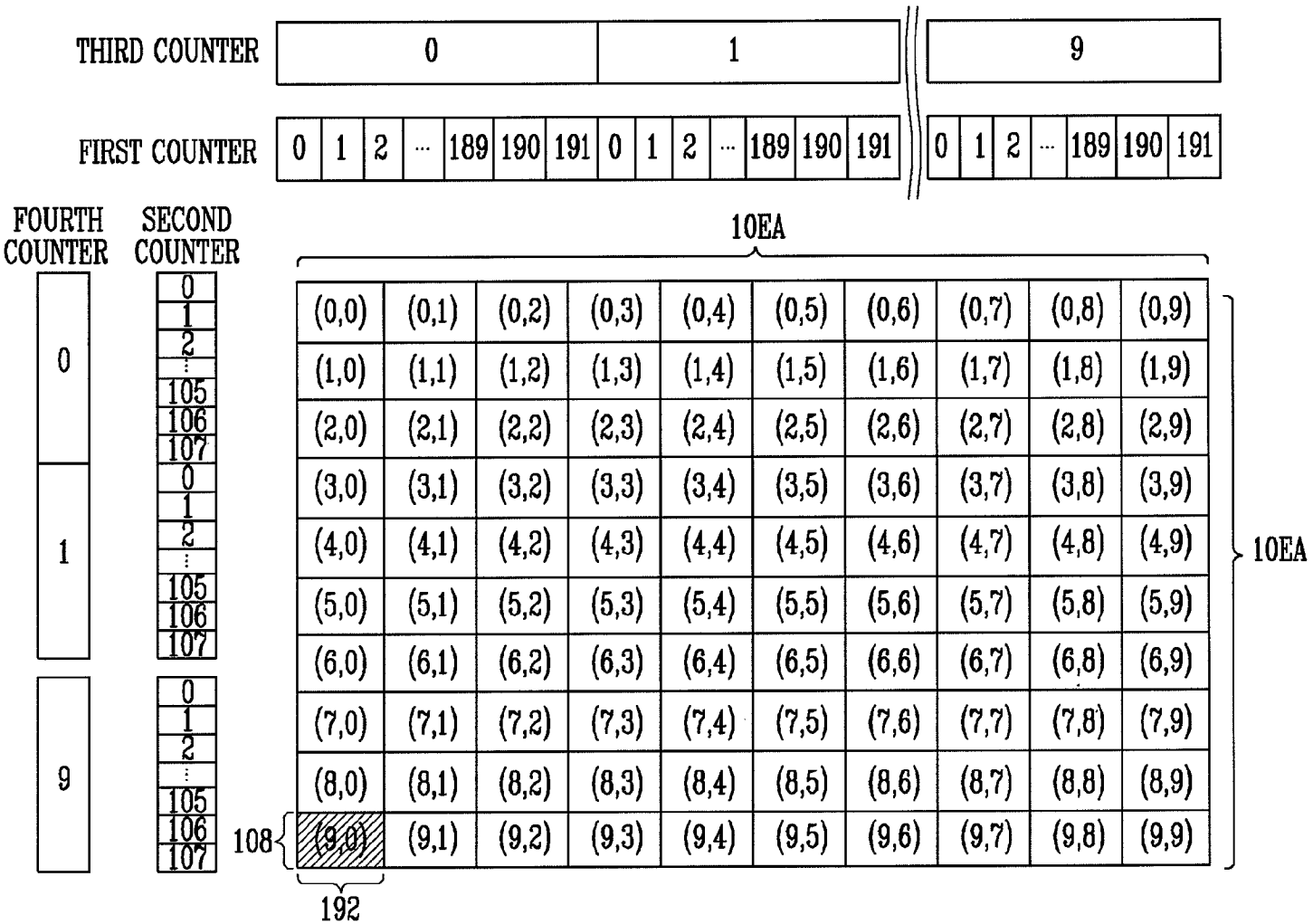
FIG. 4 is a table illustrating the block divided by the first accumulating unit of FIG. 3.

The first counter 1711 receives the first block control signal X and the data. The first counter 1711 that received the first block control signal X generates a first count signal while counting the number of data supplied in a horizontal direction to correspond to the first block control signal X as illustrated in FIG. 4. When 192 is input to the first block control signal X, the first counter 1711 generates the first count signal whenever the 192 data are input in the horizontal direction.

The second counter 1712 receives the second block control signal Y and the data. The second counter 1712 that received the second block control signal Y generates a second count signal while counting the number of data supplied in a vertical direction to correspond to the second block control signal Y. When 108 is input to the second block control signal Y, the second counter 1712 generates the second count signal whenever the 108 data are input in a vertical direction.

The third counter 1713 receives the first count signal. The third counter 1713 that received the first count signal generates the third count signal when the first count signal is input. Here, the third count signal increases in the order of 0, 1, and 2, . . . and the respective numbers mean blocks divided in horizontal units.

The fourth counter 1714 receives the second count signal. The fourth counter 1714 that received the second count signal generates the fourth count signal when the second count signal is input. Here, the fourth count signal increases in the order of 0, 1, and 2, . . . and the respective numbers mean blocks divided in vertical units. For example, in the panel with the resolution of 1920×1080, when 192 is input to the first block control signal X and 108 is input to the second block control signal Y, the panel is divided into 100 blocks.

The data accumulating unit 1715 receives the third count signal, the fourth count signal, and the data. The data accumulating unit 1715 accumulates data in the blocks divided by the third count signal and the fourth count signal to generate accumulated data. For example, the data accumulating unit 1715 adds all of the data supplied by the respective blocks every frame to generate accumulated data in the respective blocks.

Figure 5:
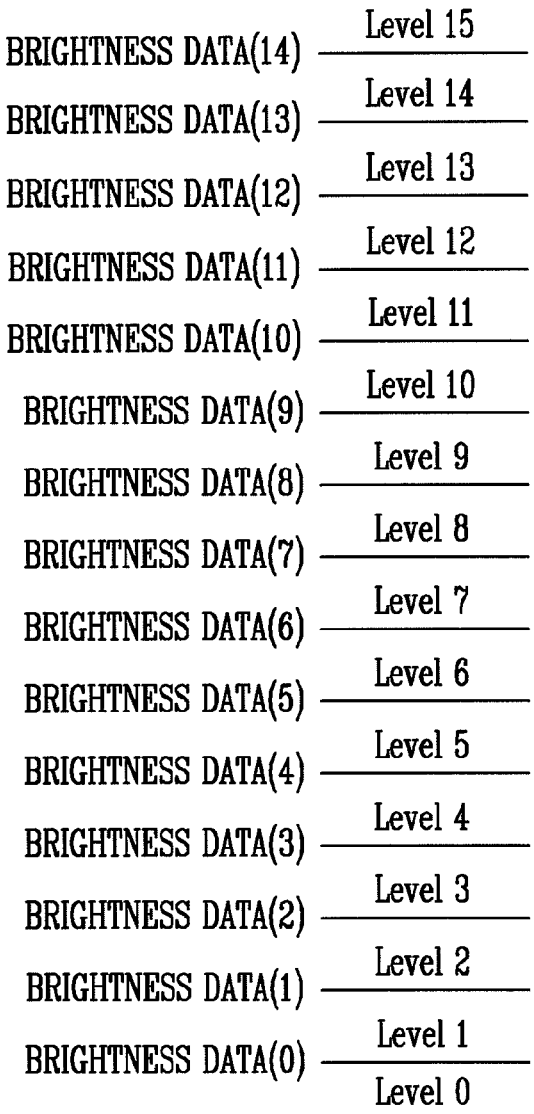
FIG. 5 is a data view illustrating brightness data stored in the storage unit of FIG. 2.

FIG. 5 is a view illustrating the brightness data stored in the storage unit. Referring to FIG. 5, a plurality of (for example, 15) different brightness data are stored in the storage unit 173. The brightness data may be set as one value of the accumulated data that may be generated by the first accumulating unit 171.

In detail, the accumulated data generated by accumulating data include brightness information of each block. The brightness data provide a reference value so that the accumulated data may be distinguished by uniform brightness components (or gray levels). For example, the brightness data may be set to correspond to the brightness of about 95%, the brightness of about 80%, . . . , and the brightness of about 5% in the respective blocks.

The level determining unit 172 compares the accumulated data and the brightness data of the respective blocks supplied by the first accumulating unit 171 with each other to generate level data to correspond to the comparison result. For example, the level determining unit 172 generates fourth level data when the accumulated data of brightness data 3 and brightness data 4 are input to supply the generated fourth level data to the second accumulating unit 174.

Figure 6:
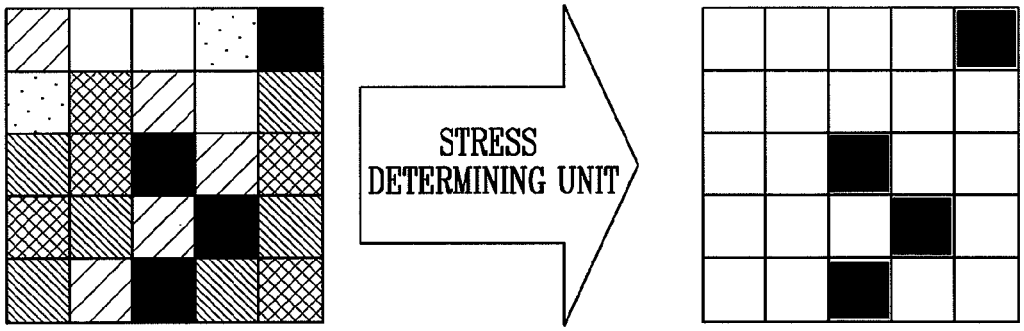
FIG. 6 is a map view illustrating the operation processes of the second accumulating unit and the stress determining unit of FIG. 2.

FIG. 6 is a view illustrating the operation processes of the second accumulating unit and the stress determining unit. Referring to FIG. 6, the second accumulating unit 174 accumulates (for example, adds or integrates) level data for j frames to generate the accumulated level data of the respective blocks. The brightness information of the blocks that emit light for the j frames is included in the accumulated level data.

The stress determining unit 175 receives the accumulated level data of the respective blocks to determine if the input accumulated level data are greater than the threshold value. The stress determining unit 175 generates the first control signal when one of the input accumulated level data is greater than the threshold value and generates the second control signal to supply the generated second control signal to the signal generator 176 when the input accumulated level data is no more than the threshold value.

Figure 7:
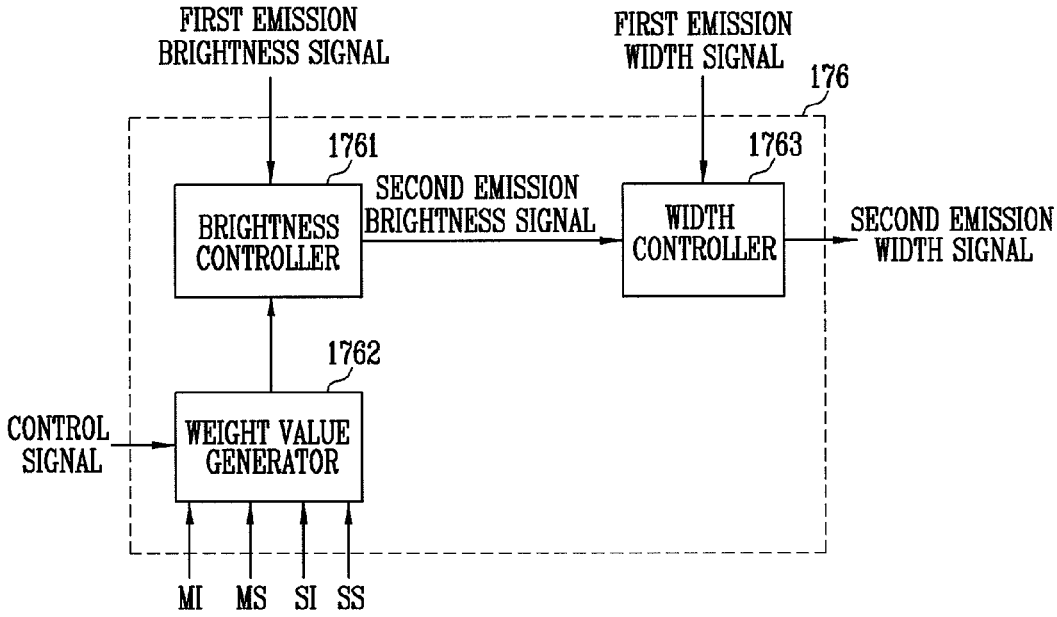
FIG. 7 is a block diagram illustrating an embodiment of the signal generator of FIG. 2.

FIG. 7 is a view illustrating an embodiment of a signal generator. Referring to FIG. 7, the signal generator 176 according to the embodiment includes a brightness controller 1761, a weight value generator 1762, and a width controller 1763.

The weight value generator 1762 receives a first control signal or a second control signal from the stress determining unit 175. The weight value generator 1762 incrementally reduces the weight value if the first control signal is input and incrementally increases the weight value if the second control signal is input.

Here, the weight value generator 1762 includes information on the largest weight value (for example, 1) and the smallest weight value (for example, 0.3) and reduces or increases the weight value between the largest weight value and the smallest weight value. In particular, the weight value generator 1762 reduces or increases the weight value in the form of an incremental step so that a change in brightness is not recognized by an observer.

The brightness controller 1761 receives the weight value from the weight value generator 1762 and receives a first emission brightness signal from the timing controller 150. The brightness controller 1761 that received the first emission brightness signal and the weight value changes the first emission brightness signal to correspond to the weight value to generate a second emission brightness signal. For example, the brightness controller 1761 multiplies the brightness of the first emission brightness signal by the weight value to generate the brightness information of the second emission brightness signal. In one embodiment, as illustrated in TABLE 1, the second emission brightness signal is generated to correspond to the first emission brightness signal and the weight value.

TABLE 1

| First emission brightness signal | Weight value | Second emission brightness signal |
|---|---|---|
| 90% | 70% (0.70) | 63% |
| 60% | 72% (0.72) | 43% |
| 30% | 74% (0.74) | 30% (min) |

In table 1, the brightness controller 1761 generates the second emission brightness signal so that brightness information of 30% is included regardless of the weight value when the first emission brightness signal is set to have the brightness of 30%. That is, the minimum brightness information is included in the brightness controller 1761 and the second emission brightness signal is generated so that brightness information of no less than the minimum brightness is included.

The width controller 1763 receives the second emission brightness signal and the first emission width signal. The width controller 1763 that received the second emission brightness signal and the first emission width signal changes the first emission width signal to correspond to the brightness information of the second emission brightness signal to generate the second emission width signal. For example, when the first emission width signal includes emission time information of 10,000 clocks and the second emission brightness signal includes the brightness information of 50%, the width controller 1763 multiplies the time (10,000 clocks) by the brightness (0.5) to generate the second emission width signal so that the emission time information of 5,000 clocks is included. Therefore, the width controller 1763 changes the brightness information (%) of the second emission brightness signal into a value between 1 and 0 and multiplies the clock information by the brightness information. The emission control line driver 160 generates the emission control signals so that the pixels 140 emit light for the time of 5,000 clocks.

Figure 8:
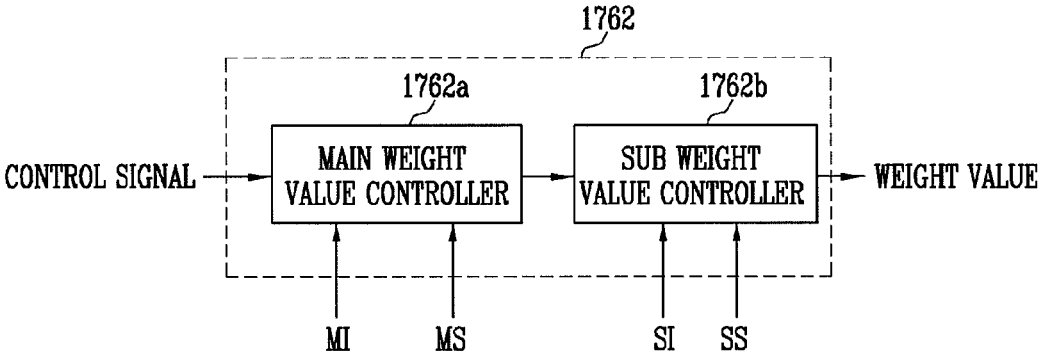
FIG. 8 is a block diagram illustrating an embodiment of the weight value generator of FIG. 7.

FIG. 8 is a view illustrating the weight value generator according to the embodiment of the present invention. Referring to FIG. 8, the weight value generator according to this embodiment includes a main weight value controller 1762*a* and a sub weight value controller 1762*b*.

Figure 9:
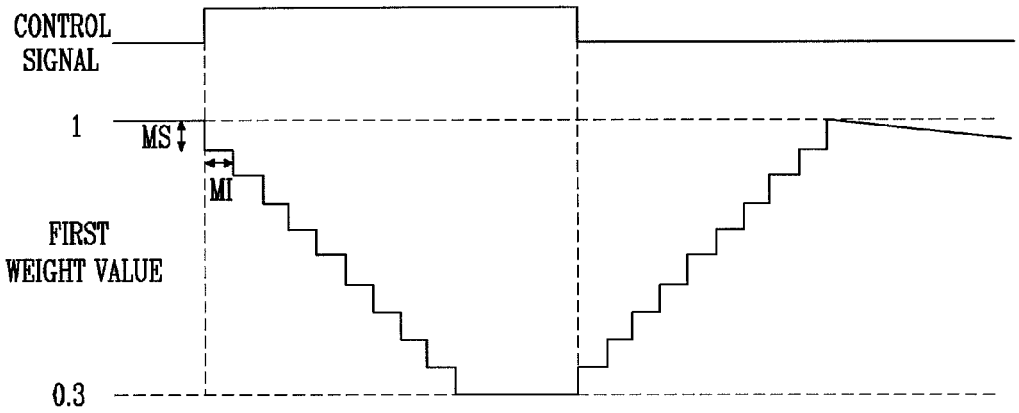
FIGS. 9 and 10 are data and flowchart views illustrating the operation processes of the main weight value controller of FIG. 8.

The main weight value controller 1762*a* receives a main step (MS) signal and a main interval (MI) signal. The MS signal represents the changed values (reduction width and increase width) of the weight value and the MI signal represents change intervals. That is, the main weight value controller 1762 generates the weight value that changes by the MS every MI to correspond to the first or second control signal as illustrated in FIG. 9.

The sub weight value controller 1762*b* receives a sub step (SS) signal and a sub interval (SI) signal. The SS signal represents the changed values (reduction width and increase width) of the weight value and the SI signal represents change intervals. Here, the SS represents change width between the MS and is set as smaller width (or number) than the MS. The SS signal represents change intervals between the MI and is set as smaller time (or number). The SS signal represents change intervals between the MI and is set as smaller time (or number) than the MI.

Figure 10:
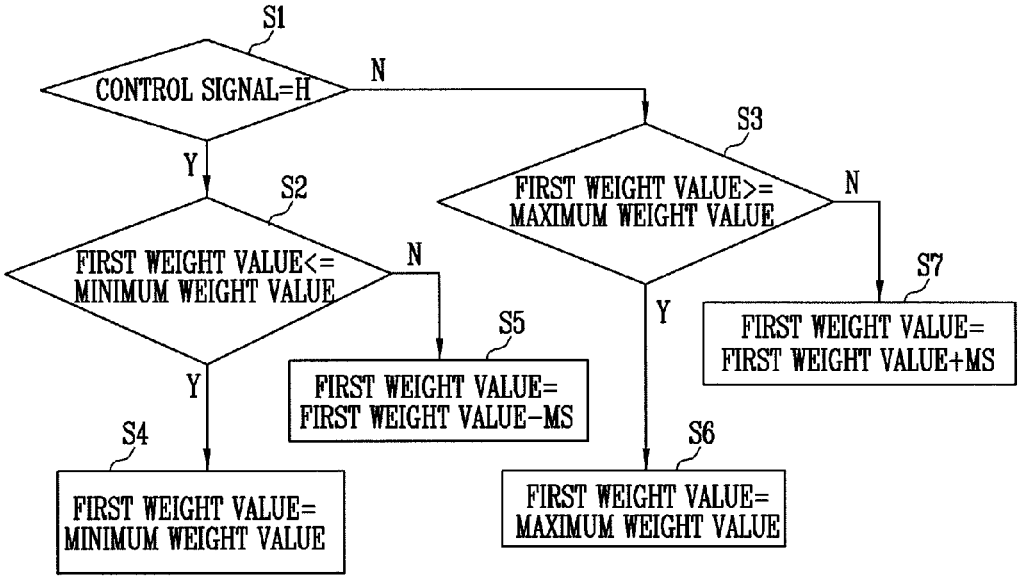

FIG. 10 is a flowchart illustrating the operation processes of the main weight value controller. Referring to FIG. 10, the main weight value controller 1762*a* determines whether the first control signal or the second control signal is input from the stress determining unit 175 (S1). When it is determined that the first control signal (high) is input in S1, the main weight value controller 1762*a* determines whether the first weight value is a value of no more than the minimum weight value (S2). When it is determined that the first weight value is no more than the minimum weight value in S2, the main weight value controller 1762*a* outputs the value of the minimum weight value as the first weight value (S4). When the first weight value is larger than the minimum weight value in S2, the first weight value is reduced by the MS (S5).

On the other hand, when the second control signal (low) is input in S1, the main weight value controller 1762*a* determines whether the first weight value is no less than the maximum weight value (S3). When it is determined that the first weight value is no less than the minimum weight value in S3, the main weight value controller 1762*a* outputs the value of the maximum weight value as the first weight value (S6). When the first weight value is set to be less than the maximum weight value in S3, the first weight value is increased by the MS (S7).

The main weight value controller 1762*a* increases or reduces the first weight value to correspond to the first control signal or the second control signal as illustrated in FIG. 9 while repeating S1 to S7.

Figure 11:
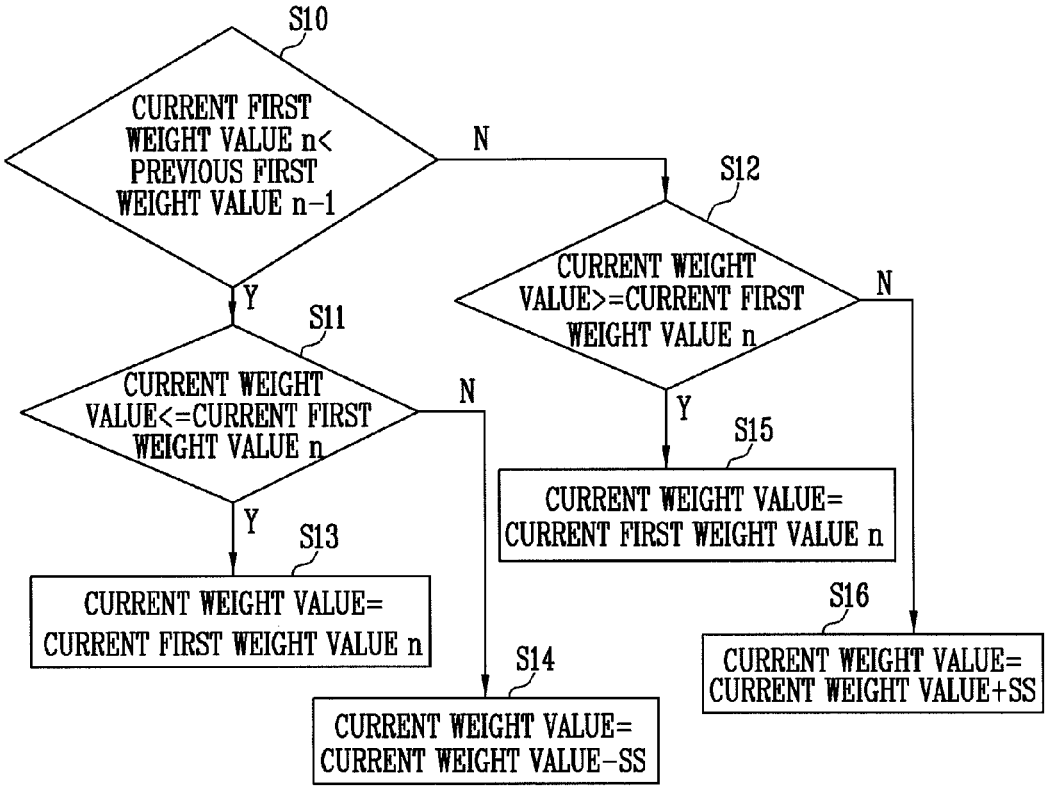
FIGS. 11 and 12 are flowchart and data views illustrating the operation processes of the sub weight value controller of FIG. 8.
Figure 12:
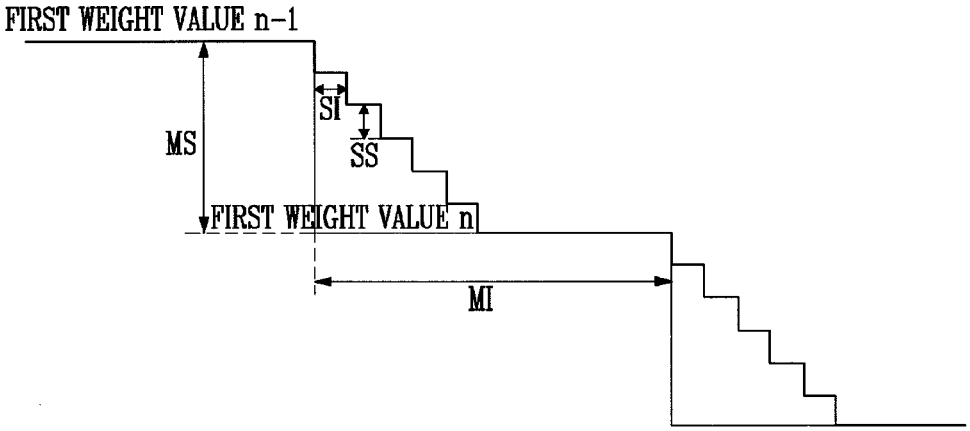

FIGS. 11 and 12 are views illustrating the operation processes of the sub weight value controller. Referring to FIGS. 11 and 12, the sub weight value controller 1762*b* receives a current first weight value n from the main weight value controller 1762*a*. The sub weight value controller 1762*b* that received the current first weight value n compares a previous first weight value n−1 with the current first weight value n (S10).

When it is determined that the previous first weight value n−1 is greater than the current first weight value n in S10, it is determined that the current weight value is no more than the current first weight value n (S11). When it is determined in S11 that the current weight value is no more than the current first weight value n, the value of the current first weight value is output as the current weight value (S13). When it is determined in S11 that the current weight value is greater than the current first weight value n, the current weight value is reduced by the SS to be output (S14).

When it is determined in S10 that the previous first weight value n−1 is less than the current first weight value n, it is determined whether the current weight value is no less than the current first weight value n (S12). When it is determined in S12 that the current weight value is no less than the current first weight value n, the value of the current first weight value is output as the current weight value (S15). When it is determined in S12 that the current weight value is less than the first weight value n, the current weight value is increased by the SS to be output (S16). The current weight value output in S13, S14, S15, and S16 is supplied to the brightness controller 1761 as the weight value.

Figure 13:
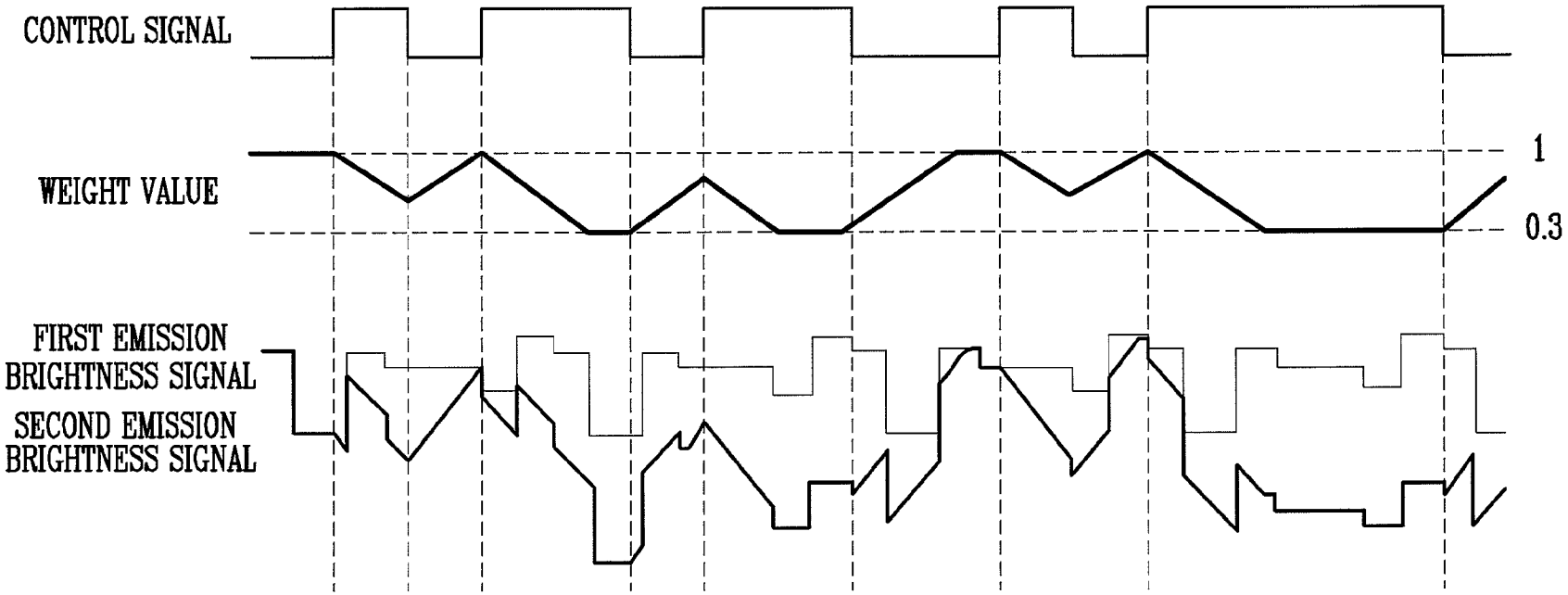
FIG. 13 is a data view illustrating second emission brightness signals corresponding to first and second control signals.

FIG. 13 is a view illustrating the second emission brightness signal corresponding to the first and second control signals. Referring to FIG. 13, the second emission brightness signal is generated according to the control signal, the weight value, and the first emission brightness signal. Here, the second emission brightness signal is set to be gradually reduced when the first control signal is input and to be gradually increased to the value of the original first emission brightness signal when the second control signal is input. That is, when brightness of a high gray level is realized in units of blocks, that is, when the first control signal is input, the brightness of a panel is reduced so that it is possible to prevent the OLEDs from being rapidly deteriorated.

Figure 14:
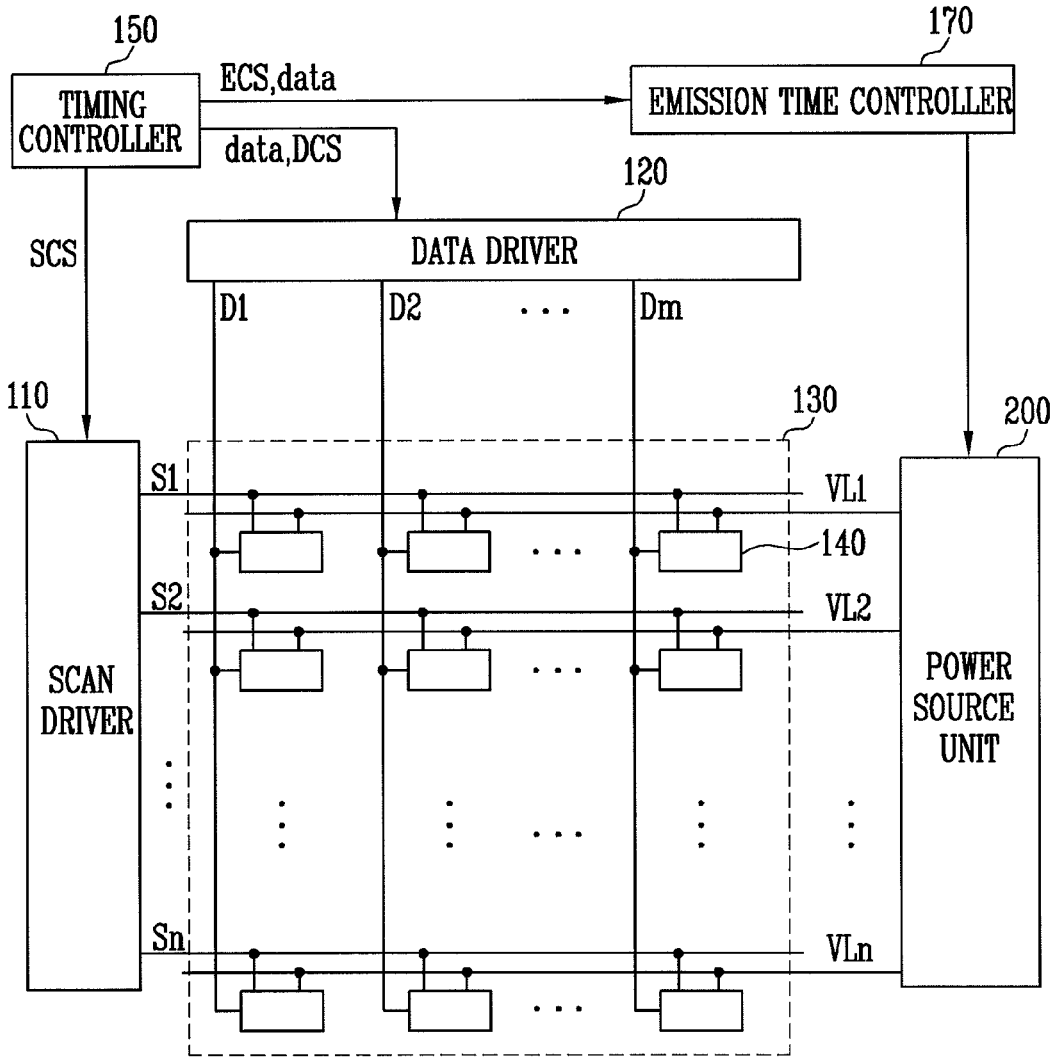
FIG. 14 is a schematic view illustrating an organic light emitting diode display according to an embodiment.

FIG. 14 is a view illustrating an organic light emitting diode display according to another embodiment. When FIG. 14 is described, the same elements as FIG. 1 are generally denoted by the same reference numerals and detailed description thereof may be omitted. Referring to FIG. 14, a power source unit 200 for supplying the first power voltage ELVDD or the second power voltage ELVSS to power source lines VL1 formed in units of horizontal lines is provided.

The power source unit 200 controls the emission times of the pixels 140 to correspond to the second emission width signal supplied from the emission time controller 170. That is, the power source unit 200 controls the emission and non-emission states of the pixels 140 while controlling the voltage of the first power voltage ELVDD or the second power voltage ELVSS supplied to the power source lines VL1 to VLn.

In detail, according to the embodiment of FIG. 1, the emission of the pixels 140 is controlled using the widths of the emission control signals. When the emission control signals are used, transistors coupled to the emission control line (one of E1 to En) must be included in the pixels 140.

However, some embodiments of pixels 140 may have circuit structures in which transistors are not coupled to the emission control lines E1 to En. In addition, various embodiments of driving methods of supplying the power voltages ELVDD or ELVSS using the power source lines VL1 to VLn in units of horizontal lines may be used.

In this case, as illustrated in FIG. 14, the emission of the pixels 140 may be controlled by controlling the voltage of the first power voltage ELVDD or the second power voltage ELVSS. Other aspects of this embodiment may be similar to the embodiment of FIG. 1.

While various aspects have been described in connection with certain exemplary embodiments, it is to be understood that the invention is not limited to the disclosed embodiments, but, on the contrary, is intended to cover various modifications and equivalent arrangements.

What is claimed is:

1. An organic light emitting diode (OLED) display, comprising:

a plurality of pixels positioned at intersections of scan lines and data lines;

an emission control unit configured to control emission times of the pixels to correspond to a second emission width signal; and an emission time controller configured to divide the pixels into a plurality of blocks and to generate the second emission width signal based on brightness history data of the blocks.

2. The display as claimed in claim 1, further comprising emission control lines coupled to the pixels, wherein the emission control unit is an emission control line driver for supplying emission control signals to the emission control lines in order to control the emission times.

3. The display as claimed in claim 2, wherein the pixels that receive the emission control signals are set in a non-emission state.

4. The display as claimed in claim 1, wherein the pixels control amounts of currents that flow from a first power voltage to a second power voltage through organic light emitting diodes (OLED) according to data signals supplied from the data lines.

5. The display as claimed in claim 4, further comprising power source lines coupled to the pixels, wherein the emission control unit is a power source unit for controlling supply time of the first power voltage or the second power voltage supplied to the power source lines in order to control the emission times.

6. The display as claimed in claim 1, wherein the emission time controller generates the second emission width signal so that emission times of the pixels are reduced if the brightness history data is greater than a threshold value.

7. The display as claimed in claim 1, wherein the emission time controller comprises:

a first accumulating unit for accumulating data of the blocks to generate accumulated data;

a level determining unit for generating level data corresponding to brightness levels of the blocks using the accumulated data;

a second accumulating unit for accumulating the level data for j frame periods (j is a natural number of no less than 2) to generate accumulated level data;

a stress determining unit for comparing the accumulated level data with a threshold value to generate a first control signal if at least one of the accumulated level data is greater than the threshold value and to otherwise generate a second control signal; and a signal generator for generating the second emission width signal according to the generated first or second control signal.

8. The display as claimed in claim 7, wherein the first accumulating unit comprises:

a first counter for receiving a first block control signal representing a number of data in a horizontal direction and the data to generate a first count signal;

a second counter for receiving a second block control signal representing a number of data in a vertical direction and the data to generate a second count signal;

a third counter for generating a third count signal that sequentially increases to correspond to the first count signal;

a fourth counter for generating a fourth count signal that sequentially increases to correspond to the second count signal; and a data accumulating unit for dividing the blocks according to the third count signal and the fourth count signal and for accumulating the data in the blocks to generate the accumulated data.

9. The display as claimed in claim 8, wherein the data accumulating unit generates the accumulated data every frame.

10. The display as claimed in claim 7, further comprising a storage unit coupled to the level determining unit to store a plurality of brightness data corresponding to different brightness levels of the accumulated data.

11. The display as claimed in claim 10, wherein the level determining unit compares the accumulated data with the brightness data to generate the level data according to a comparison result.

12. The display as claimed in claim 7, wherein the threshold value is set as one value of accumulated level data generated by the second accumulating unit.

13. The display as claimed in claim 7, wherein the signal generator generates the second emission width signal so that emission times of the pixels are incrementally reduced when the first control signal is input.

14. The display as claimed in claim 7, wherein the signal generator receives a first emission brightness signal indicating a brightness value for the pixels, a first emission width signal indicating emission time information of the pixels for one frame period, and the first control signal or the second control signal.

15. The display as claimed in claim 14, wherein the signal generator comprises:

a weight value generator for generating a weight value incrementally increased and reduced in a range between a maximum weight value and a minimum weight value;

a brightness controller for changing the first emission brightness signal according to the weight value to generate a second emission brightness signal; and a controller for changing the first emission width signal according to the second emission brightness signal to generate the second emission width signal.

16. The display as claimed in claim 15, wherein the maximum weight value is set as 1, and wherein the minimum weight value is set as a number between the maximum weight value and 0.

17. The display as claimed in claim 15, wherein the weight value generator incrementally reduces the weight value if the first control signal is supplied and incrementally increases the weight value if the second control signal is supplied.

18. The display as claimed in claim 15, wherein the first emission brightness signal comprises brightness value information, and wherein the brightness controller multiplies the weight value by a brightness value of the first emission brightness signal to generate the second emission brightness signal.

19. The display as claimed in claim 15, wherein the brightness controller stores minimum brightness information and generates the second emission brightness signal so that brightness value information of no less than the minimum brightness is generated.

20. The display as claimed in claim 15, wherein the width controller changes a brightness value included in the second emission brightness signal to a value between 1 and 0 and multiplies the changed value by emission time of the first emission width signal to generate the second emission width signal.

21. The display as claimed in claim 16, wherein the weight value generator comprises:

a weight value controller for generating a first weight value reduced or increased by a number of main steps at main intervals according to the first control signal or the second control signal; and a sub weight value controller for comparing a current first weight value with a previous first weight value to generate the weight value reduced or increased by a number of sub steps at sub intervals according to a comparison result.

22. The display as claimed in claim 21, wherein the sub intervals are smaller than the main intervals.

23. The display as claimed in claim 21, wherein the number of sub steps is less than the number of main steps.

24. A method of driving an organic light emitting diode (OLED) display, comprising:

accumulating brightness data for a plurality of blocks of pixels;

generating level data indicating brightness levels based on the accumulated brightness data of the blocks;

accumulating the level data for a plurality of frames to generate accumulated level data;

comparing the accumulated level data with a threshold value to generate a first control signal if at least one of the accumulated level data is greater than the threshold value and to otherwise generate a second control signal; and incrementally reducing brightness of the pixels if the first control signal is generated.

25. The method as claimed in claim 24, wherein the accumulated data are generated every frame.

26. The method as claimed in claim 24, wherein the threshold value is one value of the accumulated level data that may be generated.

* * * * *